US006207914B1

(12) United States Patent
Mori

(10) Patent No.: US 6,207,914 B1
(45) Date of Patent: Mar. 27, 2001

(54) PUSH-BUTTON SWITCH INCORPORATING SELF-RESTORING FUNCTION

(75) Inventor: Toshiharu Mori, Miyagi-ken (JP)

(73) Assignee: Alpa Electric Co., Ltd., Tokyo (JP)

( * ) Notice: Subject to any disclaimer, the term of this patent is extended or adjusted under 35 U.S.C. 154(b) by 0 days.

(21) Appl. No.: 09/563,965

(22) Filed: May 3, 2000

(30) Foreign Application Priority Data

May 6, 1999 (JP) ..... 11-125936

(51) Int. Cl.[7] ..... H01H 13/58

(52) U.S. Cl. ..... 200/524; 200/324; 200/520; 200/523; 200/323

(58) Field of Search ..... 200/520–524, 200/318–327

(56) References Cited

U.S. PATENT DOCUMENTS 4,543,459 * 9/1985 Hayashida ..... 200/67 D
5,223,810 * 6/1993 Van Haaren ..... 335/18
5,262,606 * 11/1993 Benson et al. ..... 200/523
5,624,023 * 4/1997 Chasen et al. ..... 200/526
5,841,085 * 11/1998 Rittinghaus et al. ..... 200/16 R
5,886,603 * 3/1999 Powell ..... 335/164

FOREIGN PATENT DOCUMENTS 7-320590 12/1995 (JP) ..... H01H/13/56

* cited by examiner

*Primary Examiner*—Michael Friedhofer
(74) *Attorney, Agent, or Firm*—Brinks Hofer Gilson & Lione

(57) ABSTRACT

A push-button switch including a sliding member, a lock pin for locking the sliding member at a certain location, a heart cam including a lock cam along which the lock pin slides, and a movable stopper member, disposed at the heart cam, for holding the lock pin in a lock position as a result of cooperating with the lock cam or for unlocking the lock pin. The push-button switch incorporates a self-restoring function, wherein friction between the lock pin and the lock cam during an auto-off state is reduced to decrease the amount of force required to unlock the lock pin, thereby reducing the solenoid actuating current, and simplifying the actuating structure, as a result of which a more reliable product with a longer life and a smaller size can be produced.

6 Claims, 7 Drawing Sheets

PUSH-BUTTON SWITCH INCORPORATING SELF-RESTORING FUNCTION

BACKGROUND OF THE INVENTION

1. Field of the Invention

The present invention relates to the structure of a switch used as a power switch used in, for example, a washing machine, a dish washer, or a drying machine, and more particularly to the structure of a push-button switch incorporating a self-restoring function.

2. Description of the Related Art

FIGS. 11 to 14 illustrate the structure of a conventional push-button switch incorporating a self-restoring function. More specifically, FIG. 11 is a partly cutaway plan view showing a state in which the push-button switch is locked. FIG. 12 illustrates the relationship between a lock cam and a lock pin of FIG. 11. FIG. 13 is a partly cutaway plan view showing a state in which a solenoid of the push-button switch is performing an actuating operation. FIG. 14 illustrates the relationship between the lock cam and the lock pin of FIG. 13.

In these figures, a frame member 11 is formed by pressing a metallic plate, such as a steel plate. An AC switch section 12 and a solenoid 13 are integrally mounted side-by-side to the frame member 11. A DC switch section 14 is mounted behind the AC switch section 12.

A sliding member 15 is slidably disposed on the AC switch section 12. By pushing in the sliding member 15, a circuit provided at the AC switch section 12 and a circuit provided in the DC switch section 14 are turned on. The sliding member 15 is biased towards an initial position thereof by a restoring spring (not shown). When the sliding member 15 is in the initial position, the circuits of the AC switch section 12 and DC switch section 14 are turned off.

A heart cam 16 is disposed at the sliding member 15, and includes a protrusion-like lock cam 16*a* at the center portion thereof. A lock pin 17 (described later) is made to slide along the lock cam 16*a*. By stopping the lock pin 17 by a surface of the lock cam 16*a*, the sliding member 15 is locked in a pushed-in state.

The lock pin 17 is formed by bending both ends of a round rod at right angles, with a lock-pin fulcrum 17*a* being formed at one end thereof and a lock-pin operating end 17*b* being formed at the other end thereof. The lock-pin fulcrum 17*a* is axially supported in a hole (not shown) formed in the frame member 11, while the lock-pin operating end 17*b*, which is rotatable, is disposed so as to slide along the lock cam 16*a* of the heart cam 16.

An actuating cam 18 includes a cam protrusion 18*a* at the center portion thereof. The cam protrusion 18*a* is rotatably axially supported by the frame member 11. One end of the actuating cam 18 is engaged and connected to an iron core 13*a* of the solenoid 13. The actuating cam 18 is formed so that it can be rotationally driven around the cam protrusion 18*a* as a fulcrum by the force of attraction of the solenoid 13. On the other hand, the other end of the actuating cam 18 is disposed near the heart cam 16 disposed at the sliding member 15, with inclined surfaces 18*b* and 18*c* together forming a triangular shape at the tip of this other end of the actuating cam 18. The actuating cam 18 is disposed between the AC switch section 12 and the frame member 11.

The operation of the conventional push-button switch incorporating a self-restoring function will be described. When the sliding member 15 is pushed in, it is kept in a pushed-in position. In this pushed-in position, the operating end 17*b* of the lock pin 17 is stopped by the lock cam 16*a*, so that the sliding member 15 is locked in the pushed-in position. From this pushed-in position, when the solenoid 13 is energized by a signal transmitted from an external control circuit (not shown), the force of attraction of the solenoid 13 causes the actuating cam 18 to rotate around the cam protrusion 18*a* as the fulcrum by the iron core 13*a*. At this time, the inclined surface 18*b* formed at the end of the actuating cam 18 which has rotated comes into contact with the operating end 17*b* from a longitudinal direction of the lock pin 17 (or a direction perpendicular to the direction of movement of the lock pin 17). and guides and moves the operating end 17*b* in a horizontal direction (or a downward direction in the figures). This causes the operating end 17*b* to disengage from a stopper section of the lock cam 16*a* of the heart cam 16, so that the sliding member 15 is unlocked.

However, in the structure of the conventional push-button switch incorporating a self-restoring function, when the sliding member 15 is in the locked state, the operating end 17*b* of the lock pin 17 is held by the stopper section of the lock cam 16*a*, whereas, when the sliding member 15 is in an auto-off state, the operating end 17*b* of the lock pin 17 is disengaged from the lock cam 16*a* as a result of pushing the operating end 17*b* of the lock pin 17 horizontally by the inclined surface 18*b* at the end of the actuating cam 18 actuated by the solenoid 13. Therefore, friction between the lock pin 17 and the lock cam 16*a* is large, so that a large force is required to unlock the lock pin 17. This results in the problem that the amount of actuating current supplied to the solenoid 13 becomes large.

In addition, since the lock pin 17 is forced to disengage from the stopper section of the lock cam 16*a* by pushing the lock pin 17 horizontally, the lock pin 17 is severely worn, which may prevent a highly reliable product with a long life from being manufactured.

Further, the actuating cam 18 actuated by the solenoid 13 is rotated to unlock the lock pin 17, so that the actuating cam 18 is increased in size, thus making it difficult to reduce the size of the product.

SUMMARY OF THE INVENTION

Accordingly, in order to overcome the above-described problems, it is an object of the present invention to provide a more reliable, longer-life, small push-button switch structure incorporating a self-restoring function by simplifying an actuating structure and reducing the actuating electrical current in a solenoid as a result of reducing friction between a lock pin and a lock cam during an auto-off state in order to reduce the amount of force required to unlock the lock pin.

To this end, according to the present invention, there is provided a push-button switch comprising:

- a sliding member;
- a lock pin for locking the sliding member at a certain location;
- a heart cam including a lock cam along which the lock pin slides; and
- a movable stopper member, disposed at the heart cam, for holding the lock pin at a lock position as a result of cooperating with the lock cam or for unlocking the lock pin.

The push-button switch may be such as to comprise a switch body; the sliding member slidably provided at the switch body; the lock pin, with a first end thereof being axially stopped by the sliding member and a second end thereof being rotatable; the heart cam provided at the switch body, with the second end of the lock pin sliding along the heart cam; an actuating member for unlocking the lock pin; a restoring spring for biasing the sliding member in a restoring direction; the movable stopper member movable along a sliding path of the lock pin and to a location away from the sliding path; wherein, after the lock pin has been held at the lock position by the lock cam of the heart cam and the stopper member, the stopper member is moved by the actuating member in order to unlock the lock pin.

When the push-button switch comprises a slide member, a lock pin, a heart cam, and a movable stopper member, a lock cam surface which extends from a first end of the lock cam to a second end, at a stopper-member side, of the lock cam may be formed by an inclined surface formed so as to extend towards an operating section of the sliding member from the first end of the lock cam to the second end, at the stopper-member side, of the lock cam.

When the push-button switch comprises a slide member, a lock pin, a heart cam, and a movable stopper member, the stopper member may be formed at the heart cam so as to be movable in a direction perpendicular to a surface in which a cam groove in the heart cam is formed.

When the push-button switch comprises a slide member, a lock pin, a heart cam, and a movable stopper member, the stopper member may be formed at the heart cam so as to be movable parallel to a surface in which a cam groove in the heart cam is formed.

When the push-button switch comprises a switch body, the slide member, the lock pin, the heart cam, an actuating member, a restoring spring, and the movable stopper member, the actuating member may comprise a solenoid, the stopper member being moved by an attracting force of the solenoid.

DESCRIPTION OF THE PREFERRED EMBODIMENTS

Figure 1:
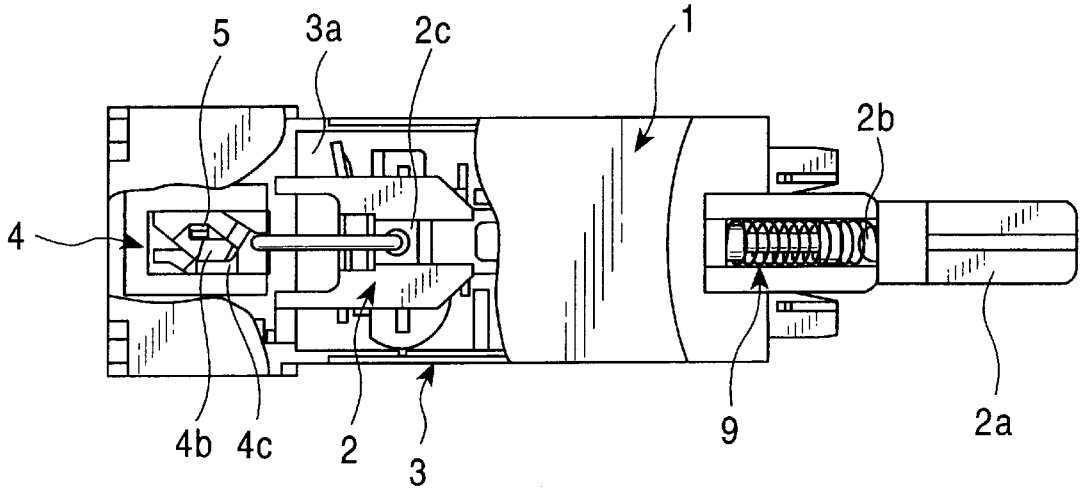
FIG. 1 is a partly cutaway plan view of a first embodiment of the push-button switch incorporating a self-restoring function in accordance with the present invention.
Figure 2:
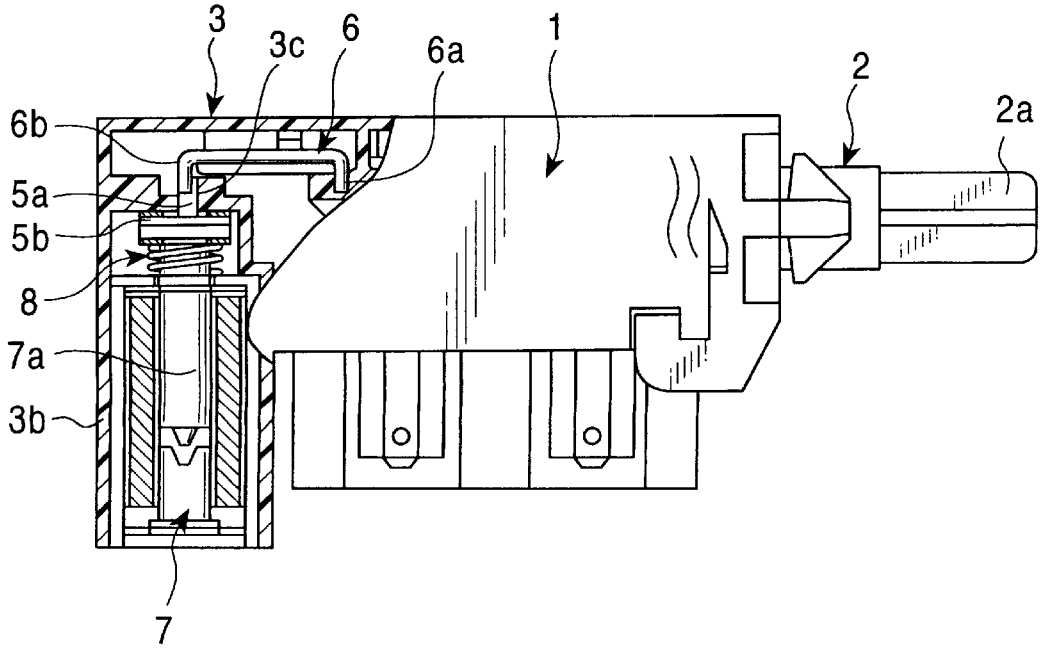
FIG. 2 is a partly cutaway front view of the first embodiment of the push-button switch incorporating a self-restoring function in accordance with the present invention.
Figure 3:
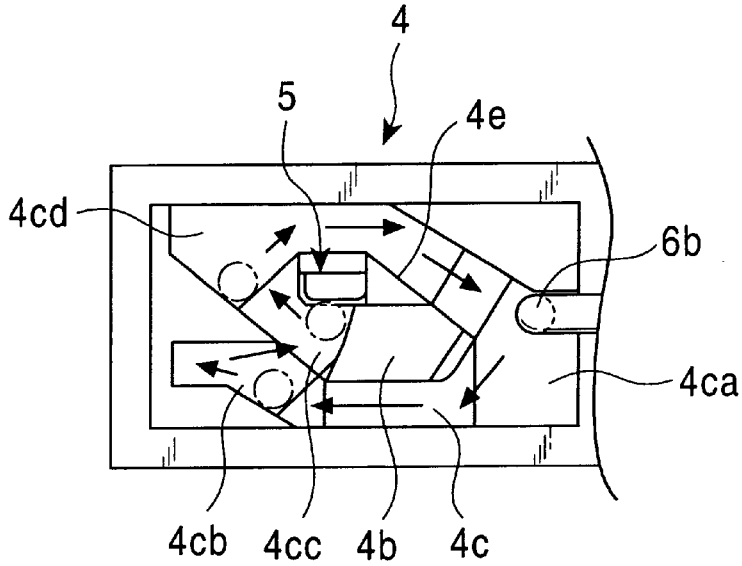
FIG. 3 illustrates the relationship between a heart cam and a lock pin when a sliding member is manually operated in the present invention.
Figure 4:
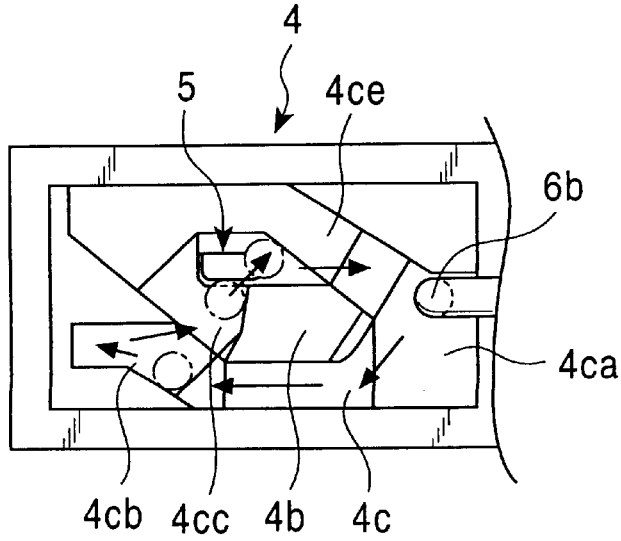
FIG. 4 illustrates the relationship between the heart cam and the lock pin during an auto-off state in the present invention.
Figure 5:
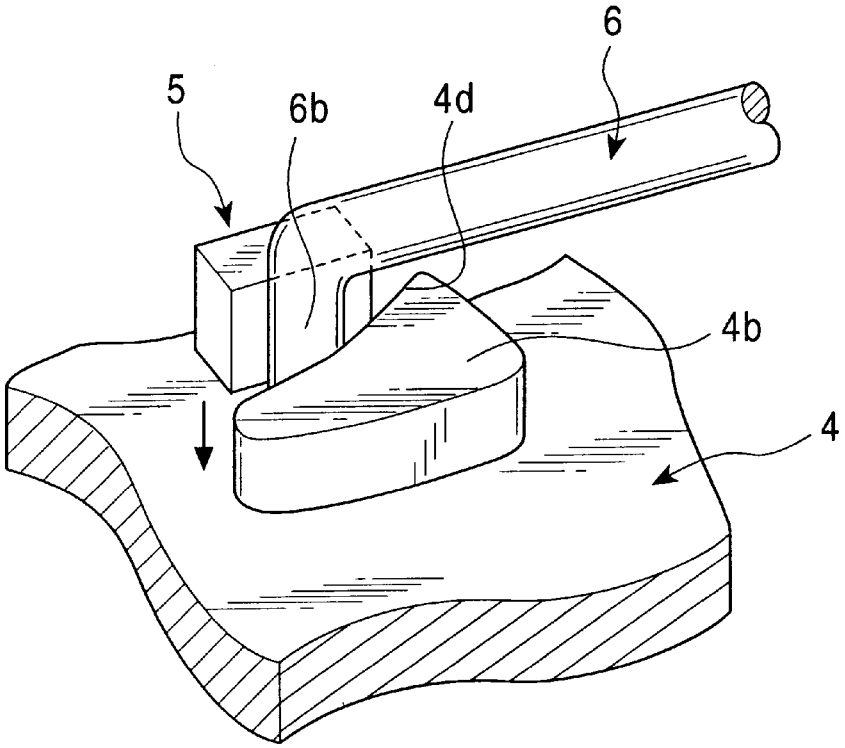
FIG. 5 is a perspective view schematically showing the relationship between a lock cam and a stopper member during the auto-off state in the present invention.
Figure 6:
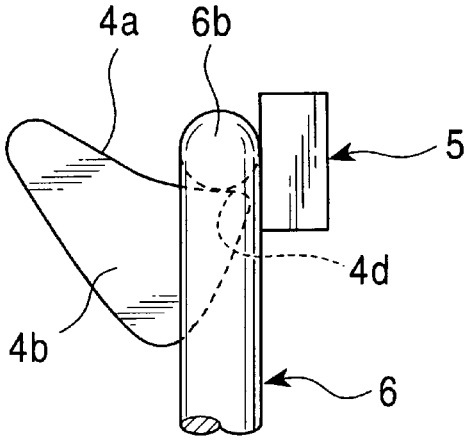
FIG. 6 is a schematic plan view of FIG. 5.
Figure 7:
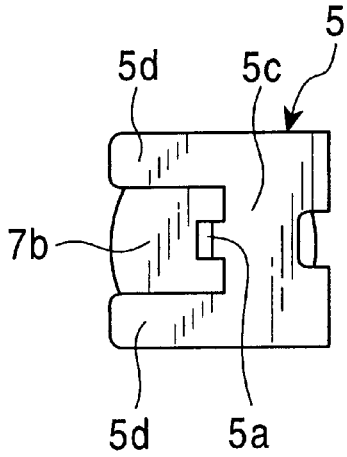
FIG. 7 is a plan view showing the state of connection of the stopper member and a solenoid in accordance with the present invention.
Figure 8:
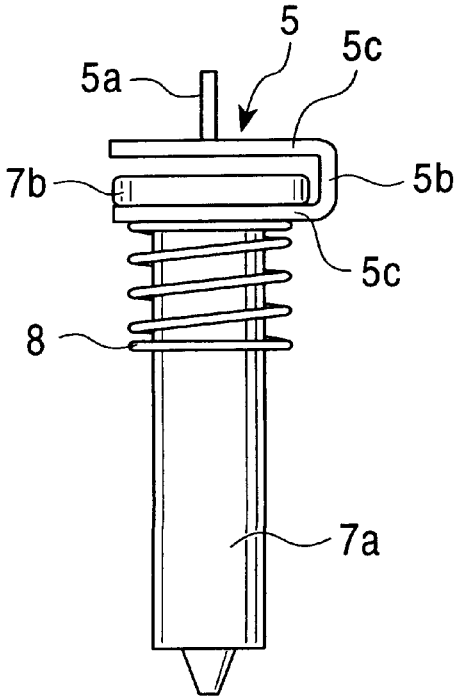
FIG. 8 is a side view of FIG. 7.

Hereunder, a description of preferred embodiments will be given with reference to FIGS. 1 to 10. FIGS. 1 to 8 illustrate the structure of a first embodiment of the push-button switch incorporating a self-restoring function in accordance with the present invention. More specifically, FIG. 1 is a partly cutaway plan view of the first embodiment of the push-button switch in accordance with the present invention. FIG. 2 is a partly cutaway front view of the push-button switch in accordance with the present invention. FIG. 3 illustrates the relationship between a heart cam and a lock pin when a sliding member is manually operated. FIG. 4 illustrates the relationship between the heart cam and the lock pin during an auto-off state. FIG. 5 is a perspective view schematically showing the relationship between a lock cam and a stopper member during the auto-off state. FIG. 6 is a schematic plan view of FIG. 5. FIG. 7 is a plan view showing a state in which the stopper member and a solenoid are connected together. FIG. 8 is a side view of FIG. 7.

In these figures, a frame member 1 is formed of an insulating material such as synthetic resin, and is shaped like a box. The frame member 1 is mounted so as to cover an opening in a housing (described later).

A sliding member 2 is formed of an insulating material such as synthetic resin. An operating section 2*a* is formed at one end thereof so as to protrude outward from a switch body. An accommodating section 2*b* for accommodating a restoring spring (described later) is provided at the center portion of the operating section 2*a*.On the other hand, a shaft hole 2*c* in which one end of a lock pin (described later) is axially supported is formed in the other end of the sliding member 2. The lock pin is disposed so as to be movable in the switch body along with the sliding member 2. A contact actuating means (not shown) is provided at the center portion of the sliding member 2. The contact actuating means is provided to turn on and off a switch circuit of the switch body.

A housing 3 is formed of an insulating material such as synthetic resin, and is shaped like a box. An opening 3*a* is formed in its top surface. A switch circuit (not shown) is formed at the opening 3*a* formed in the housing 3. The sliding member 2 is slidably disposed in the opening 3*a* formed in the housing 3. When the switch circuit of the switch body is actuated by the contact actuating means (not shown) provided at the sliding member 2, switching of the switch circuit is performed.

At the rear end of the housing 3, an actuating member mounting section 3*b* for mounting an actuating member (described later) opens into a side opposite to the side into which the opening 3*a* opens. A window 3*c*, which is a small through hole, is formed in a side of the actuating member mounting section 3*b* with a bottom. A heart cam 4 forming a lock mechanism of the switch body is formed at the opening 3*a* side through the window 3*c*.

The heart cam 4 includes a lock cam 4*b* and a cam groove 4*c*. A lock cam surface 4*a* being a heart-shaped protrusion is formed at the center portion of the heart cam 4. The cam groove 4*c* is defined by a plurality of inclined surfaces and steps. A stopper member 5 is provided so as to protrude from a sliding path (described later) on the cam groove 4*c* on which the lock pin slides, and so as to be movable in a direction opposite to the direction in which the protrusion formed at the lock cam 4*b* protrudes. The stopper member 5 is formed separately of the heart cam 4, and includes a protruding section 5*a* and a base section 5*b* which is larger than the protruding section 5*a*. The protruding section 5*a* is inserted into the window 3*c* formed in the actuating member mounting section 3*b* of the housing 3. The base section 5*b* of the stopper member 5 has provided thereat an upper section 5*c* and a lower section 5*c* which are parallel to each other. The parallel sections 5*c* are formed by bending one metallic plate piece into a U shape. When these parallel sections 5*c* are extended, a pair of tongues 5*d* are formed on the left and right sides of each section 5*c*, whereby a connecting section with an iron core of the solenoid (described below) is formed.

The lock pin 6 is formed by bending. both ends of a round wire material into a substantially U shape, with a fulcrum 6*a* being formed at one end thereof and an operating end 6*b* being formed at the other end thereof. By axially supporting the fulcrum 6*a* in the shaft hole 2*c* in the sliding member 2, the operating end 6*b* is disposed so as to be rotatable with the shaft hole 2*c* as a fulcrum. The operating end 6*b* engages the groove 4*c* in the heart cam 4 formed at the housing 3 so as to slide on the groove 4*c* as the sliding member 2 moves.

An actuating member 7 comprises a solenoid including an iron core 7*a* in its interior. The base 5*b* of the stopper member 5 is connected to an end of the iron core 7*a*. Hereunder, the connection of the base section 5*b* of the stopper member 5 and the solenoid will be described in detail.

As shown in FIGS. 7 and 8, in the connecting structure, a flange 7*b* of the iron core 7*a* in the solenoid is disposed between the parallel sections 5*c* of the base section 5*b* so that there is a small play formed in a space defined by the parallel sections 5*c* and the four tongues 5*d*. The iron core 7*a* is prevented from being dislodged by left and right tongues 5*d*.

The solenoid is formed so that, when it is energized, the stopper member 5 moves as a result of being attracted along with the iron core 7*a*. Here, since the stopper member 5 is connected to the iron core 7*a* so that a small play is formed therebetween, the stopper member 5 can smoothly move vertically in the window 3*c* even if, for example, there is play at the iron core 7*a* in the solenoid or there are variations in the mounting postures of the solenoid.

A restoring coil spring 8 is mounted to the iron core 7*a* to restore the stopper member 5 to its initial position after the stopper member 5 has been attracted. In this case, the base section 5*b* of the stopper 5 is made to contact the side of the actuating member mounting section 3*b* of the housing 3 with a bottom in order to regulate the position of the stopper member 5.

A restoring spring 9 is a coil formed by winding a wire material, and is accommodated in the spring-accommodating section 2*b* of the sliding member 2. The restoring spring 9 is formed so that the sliding member 2 slidably mounted to the switch body can, from its pushed-in position, be restored to its initial position when the sliding member 2 is unlocked.

A description of the operation of the above-described push-button switch incorporating a self-restoring function in accordance with the present invention will be given. When the operating section 2*a* of the sliding member 2 is pushed in, the lock pin 6 whose fulcrum 6*a* is axially supported in the sliding member 2 moves, so that the operating end 6*b* of the lock pin 6 is brought into engagement with the groove 4*c* in the heart cam 4 disposed at the housing 3, and slides on the cam groove 4*c* as the sliding member 2 moves. Here, the operating end 6*b* moves along the groove 4*c* in the heart cam 4 from a groove surface 4*ca* (shown in FIG. 3) to a groove surface 4*cb* (shown in FIG. 3) in the directions of the arrows. At a groove surface 4*cc* disposed at an intermediate point, the operating end 6*b* gets locked as a result of cooperation of the lock cam 4*b* and the stopper member 5. In this state, the sliding member 2 is locked in its pushed-in position, so that the circuit (not shown) of the switch body is brought into an on state.

From the above-described locked state, when the switch circuit is to be manually turned off, the operating section 2*a* is pushed in further, causing the operating end 6*b* to move along the cam groove 4*c* from the cam groove surface 4*cc* to a cam groove surface 4*cd*, and, thus, to disengage from both the lock cam 4*b* and the stopper member 5. When the operating end 6*b* is disengaged, it moves back from the cam groove surface 4*cd* to the cam groove surface 4*ca* in the directions of the arrows, as indicated in FIG. 3. When the operating end 6*b* returns to the cam groove surface 4*ca*, it is in its initial position, whereby the circuit of the switch body is brought into an off state.

As shown in FIGS. 3 and 4, a guide wall 4*e* is formed on the heart cam 4. The guide wall 4*e* is taller than a side defining the cam groove 4*cd*, but shorter than the stopper member 5. It is formed so that, even when the operator pushes in the operating section 2*a* again by mistake when the operating end 6*b* is being moved from the cam groove surface 4*cd* to the cam groove surface 4*ca*, the operating end 6*b* does not come into contact with the stopper member 5.

In activating the automatic restoring (auto-off) function, a signal from an external control circuit (not shown) energizes the coil of the solenoid of the actuating member 7 in order to attract and move the iron core 7*a* as well as the stopper member 5 connected to the iron core 7*a* by the attracting force of the solenoid.

This means that the stopper member 5 is attracted and moved towards the actuating member 7, that is, towards the lower side in FIG. 4 in a direction perpendicular to the surface in which the cam groove 4*c* in the heart cam 4 is formed, causing the operating end 6*b* to disengage from the stopper member 5.

As shown in FIG. 6, an inclined surface 4*d* is formed at the lock cam surface 4*a* of the lock cam 4*b* by which the operating end 6*b* is stopped so as to extend towards the operating section 2*a* of the sliding member 2 from one end of the lock cam 4*b* to the other end side (or the side of the stopper member 5) of the lock cam 4*b*.Since the inclined surface 4*d* is inclined in the direction in which the operating section 2*a* is restored to its initial position, the lock pin operating end 6*b* is guided by the inclined surface 4*d* and moves from the cam groove surface 4*cc* to a cam groove surface 4*ce*, as indicated in FIG. 4, in order to be restored to the location of the cam groove surface 4*ca*, that is, its initial position.

In the structure of the above-described push-button switch incorporating a self-restoring function in accordance with the present invention, the operating end 6*b* of the lock pin 6 is held in its locked position as a result of the cooperation of the lock cam 4*b* of the heart cam 4 and the movable stopper member 5, and the lock pin 6 is unlocked by moving the stopper member 5. Therefore, excessive force is not exerted between the operating end 6*b* and the lock cam 4*b*, thereby reducing friction. In addition, the amount of force required to unlock the lock pin 6 can be reduced, making it possible to reduce the amount of starting current supplied to the actuating member 7.

Since the inclined surface 4*d* is formed at the lock cam surface 4*a* of the lock cam 4*b* in order to guide the lock-pin operating end 6*b* towards the operating section 2*a* of the sliding member 2, it is no longer necessary to forcingly disengage the operating end 6*b* from the lock cam 4*b*. Therefore, wear is reduced, resulting in the production of a more reliable product with a longer life.

Since the stopper member 5 is directly connected to the actuating member 7, the actuating mechanism can be simplified, making it easier to reduce the size of the product.

Figure 9:
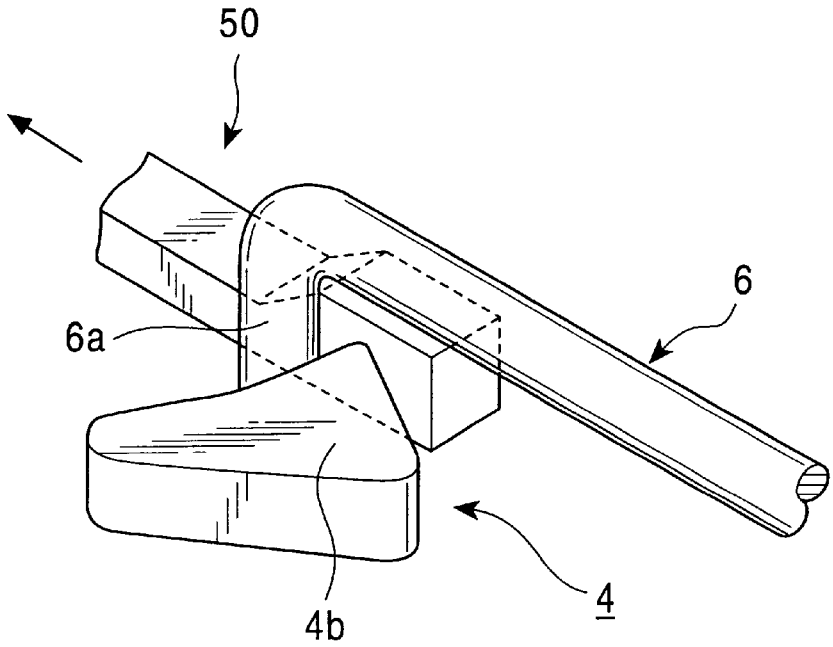
FIG. 9 is a schematic perspective view of a second embodiment of the push-button switch incorporating a self-restoring function, in which the relationship between a lock cam and a stopper member during an auto-off state is shown.
Figure 10:
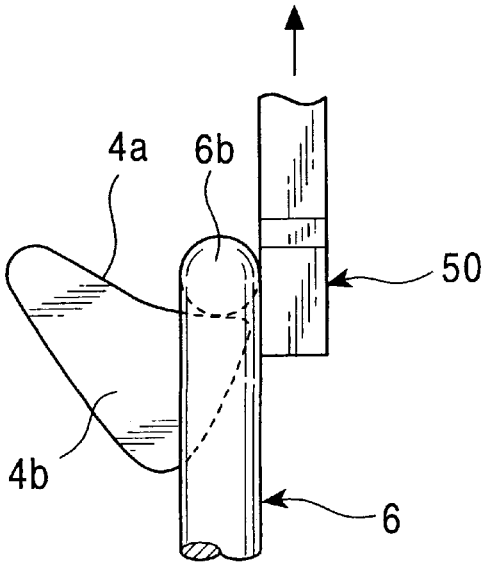
FIG. 10 is a schematic plan view of FIG. 9.
Figure 11:
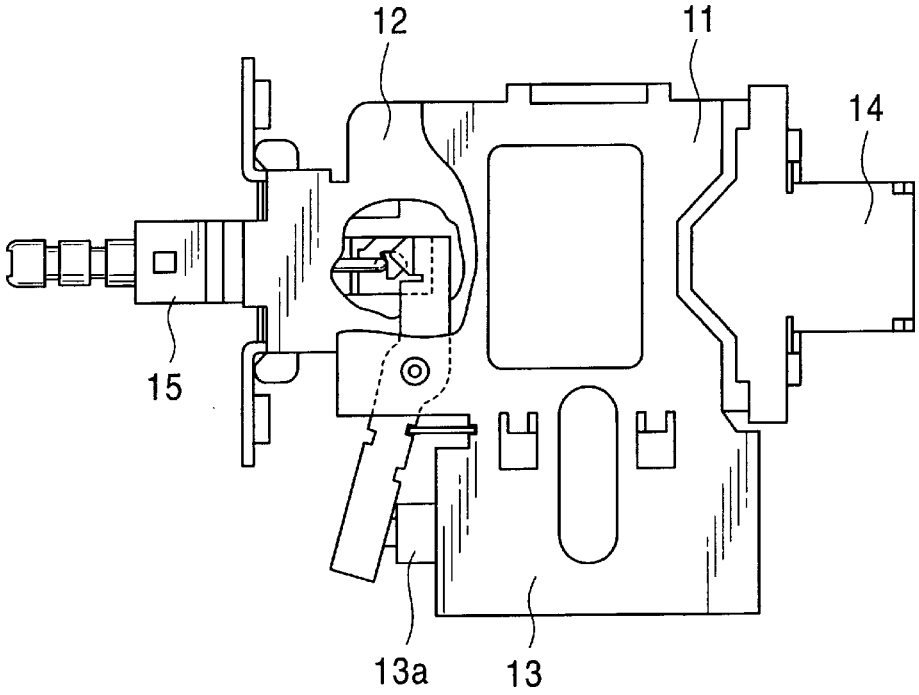
FIG. 11 PRIOR ART
FIG. 11 is a partly cutaway plan view of a conventional push-button switch incorporating a self-restoring function in a locked state.
Figure 12:
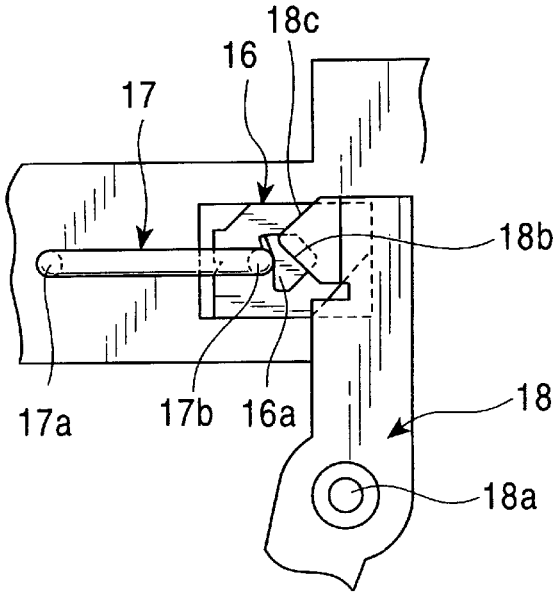
FIG. 12 PRIOR ART
FIG. 12 illustrates the relationship between a lock cam and a lock pin of FIG. 11.
Figure 13:
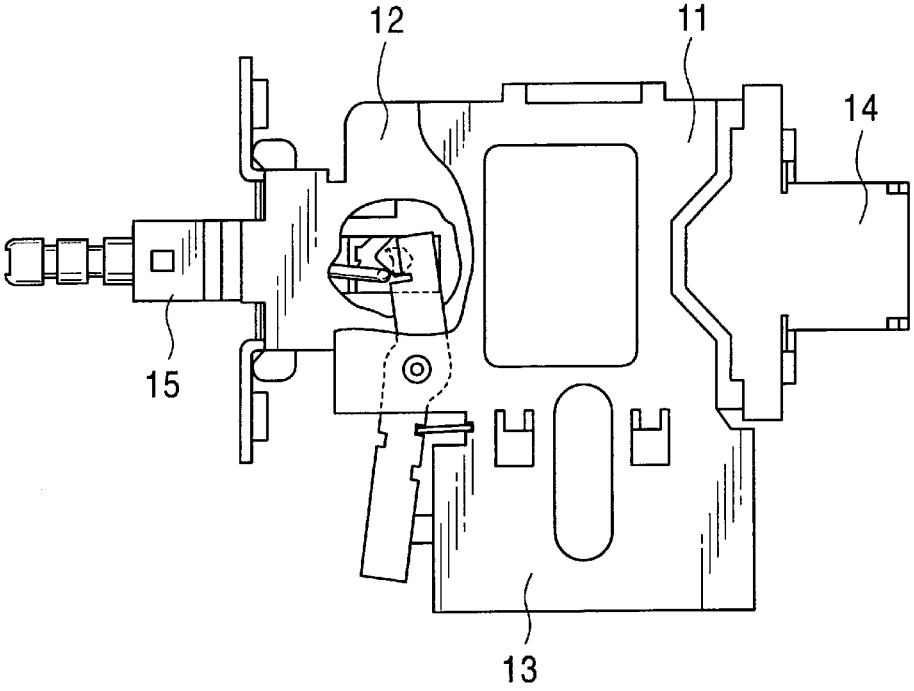
FIG. 13 PRIOR ART
FIG. 13 is a partly cutaway plan view showing a state in which a solenoid of the conventional push-button switch incorporating a self-restoring function is performing an actuating operation.
Figure 14:
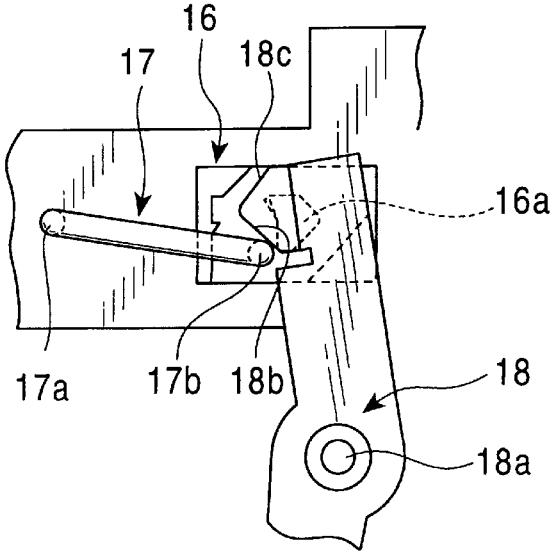
FIG. 14 PRIOR ART
FIG. 14 illustrates the relationship between the lock cam and the lock pin of FIG. 13.

FIGS. 9 and 10 illustrate the structure of a second embodiment of the push-button switch incorporating a self-restoring function in accordance with the present invention. More specifically, FIG. 9 is a perspective view schematically showing the relationship between a lock cam, a stopper member, and a lock pin when the push-button switch is in an auto-off state, while FIG. 10 is a schematic plan view of FIG. 9.

Component parts corresponding to those illustrated in FIGS. 1 to 8 are given the same reference numerals and will not be described below.

The second embodiment push-button switch differs from the first embodiment push-button switch in that the structure of a stopper member 50 is partly different from that of the stopper member 5. More specifically, the stopper member 50 is structured so that an actuating member 7 moves it in a direction which is different from the direction in which the actuating member 7 moves the stopper member 5 of the first embodiment push-button switch. As shown by the arrow in FIG. 10, the stopper member 50 is structured so that it moves as a result of being attracted in a direction parallel to the surface in which a groove 4*c* of a heart cam 4 is formed.

Here, the mounting location of the actuating member 7 to a housing 3 can be changed with the direction of movement of the stopper member 50, so that the switch body can be designed with greater freedom.

In the structure of the second embodiment push-button switch incorporating a self-restoring function, excessive force is not exerted between an operating end 6*b* and a lock cam 4*b*, so that friction therebetween is reduced. In addition, the amount of force required to unlock a lock pin 6 can be reduced, making it possible to reduce starting current supplied to the actuating member 7.

In addition, it no longer becomes necessary to forcingly disengage the lock pin operating end 6*b*, thereby reducing wear and making it possible to produce a more reliable product with a longer life, so that the actuating mechanism can be simplified, making it easier to reduce the size of the product.

Although, in the previous embodiments, the lock pin 6 is axially supported in the sliding member 2, and the heart cam 4 is formed at the housing 3. the present invention is not limited thereto. For example, the lock pin 6 may be axially supported in the housing 3, and the heart cam 4 may be formed at the sliding member 2. It is obvious that, even this case, the same advantages are obtained.

In addition, the structure of the heart cam 4 is not limited to those used in the previous embodiments. For example, the form of the lock cam 4*b*, the form of the cam groove 4*c*, etc., may be variously modified within the scope of the present invention.

As can be understood from the foregoing description, in the push-button switches incorporating a self-restoring function in accordance with the present invention, a movable stopper member is provided at the heart cam in order to hold the lock pin in the lock position as a result of cooperation with the lock cam, or in order to disengage the lock pin. Therefore, excessive force is not exerted between the lock pin and the lock cam, thereby reducing friction therebetween, so that the sliding member can be reliably unlocked.

The push-button switch may be such as to comprise the movable stopper member movable along a sliding path of the lock pin and to a location away from the sliding path, wherein, after the lock pin has been held in the lock position by the lock cam of the heart cam and the stopper member, the stopper member is moved by the actuating member in order to unlock the lock pin. Therefore, the force required to unlock the lock pin can be made small, making it possible to reduce the amount of starting electrical current supplied to the actuating member.

When the push-button switch comprises a slide member, a lock pin, a heart cam, and a movable stopper member, a lock cam surface which extends from a first end of the lock cam to a second end, at a stopper-member side, of the lock cam may be formed by an inclined surface formed so as to extend towards an operating section of the sliding member from the first end of the lock cam to the second end, at the stopper-member side, of the lock cam. Therefore, it is no longer necessary to forcingly unlock the lock pin, thereby reducing wear and making it possible to provide a more reliable product with a longer life.

When the push-button switch comprises a slide member, a lock pin, a heart cam, and a movable stopper member, the stopper member may be formed at the heart cam so as to be movable in a direction perpendicular to a surface in which a cam groove in the heart cam is formed. Therefore, a simple lock-pin locking structure can be used, without the necessity of increasing the size of the heart cam.

When the push-button switch comprises a slide member, a lock pin, a heart cam, and a movable stopper member, the stopper member may be formed at the heart cam so as to be movable parallel to a surface in which a cam groove in the heart cam is formed. Therefore, the mounting location of the actuating member to be mounted to the housing can be changed with the direction of movement of the stopper member, so that the switch body can be designed with greater freedom.

When the push-button switch comprises a switch body, the slide member, the lock pin, the heart cam, an actuating member, a restoring spring, and the movable stopper member, the actuating member may comprise a solenoid, the stopper member being moved by an attracting force of the solenoid. Therefore, the lock pin can be reliably unlocked using a simple structure.

What is claimed is:

1. A push-button switch comprising:

a switch frame member;

a sliding member that is slidably supported by the switch frame member so as to be movable between an advanced position and a retreated position;

a restoring spring for biasing the sliding member towards the retreated position;

a lock pin to lock the sliding member at the advanced position, said lock pin having a first end being axially supported by either one of the sliding member and the switch frame member;

a heart cam for guiding a second end of the lock pin, said heart cam provided at either one of the sliding member and the switch frame member which does not axially support the first end of the lock pin, said heart cam comprising a lock cam for holding the second end of the lock pin when the sliding member is in the advanced position, and a cam groove along which the lock pin slides for guiding the second end of the lock pin around the lock cam when the sliding member is moved between the advanced position and the retreated position; and a movable stopper member for cooperating with the lock cam to hold the second end of the lock pin when the sliding member is in the advanced position, said stopper member being disposed adjacent to the lock cam of the heart cam and being movable between a stopping position and a releasing position, wherein when the stopper member is in the stopping position, the stopper member cooperates with the lock cam to hold the lock pin when the sliding member is in the advanced position, and when the stopper member is in the releasing position, the stopper member permits the lock pin to disengage from the lock cam to permit the sliding member to move to the retreated position.

2. A push-button switch according to claim 1, wherein a lock cam surface which extends from a first end of the lock cam to a second end, at a stopper-member side, of the lock cam is formed by an inclined surface formed so as to extend towards an operating section of the sliding member from the first end of the lock cam to the second end, at the stopper-member side, of the lock cam.

3. A push-button switch according to claim 1, wherein the stopper member is movable in a direction substantially perpendicular to a surface of the cam groove of the heart cam.

4. A push-button switch according to claim 3, wherein the stopper member is moved into and out of the surface of the cam groove by an actuating member, said actuating member comprising a solenoid and a solenoid spring, wherein the stopper member is moved to the releasing position by an attracting force of the solenoid, and is moved to the stopping position by a biasing force of the solenoid spring.

5. A push-button switch according to claim 1, wherein the stopper member is movable in direction that is substantially parallel to a surface of the cam groove of the heart cam.

6. A push-button switch according to claim 5, wherein the stopper member is moved laterally with respect to the surface of the cam groove by an actuating member, said actuating member comprising a solenoid and a solenoid spring, wherein the stopper member is moved to the releasing position by an attracting force of the solenoid, and is moved to the stopping position by a biasing force of the solenoid spring.

* * * * *